US005170725A

United States Patent [19]

Sass et al.

[11] Patent Number: 5,170,725

[45] Date of Patent: Dec. 15, 1992

[54] METHOD AND SYSTEM OF PYROPROCESSING WASTE PRODUCTS, PARTICULARLY SCRAP METAL, ADULTERATED BY ORGANIC COMPONENTS

[75] Inventors: Heiner Sass, Emmering; Paul Freimann, St. Ulrich, both of Fed. Rep. of Germany

[73] Assignee: SMG Sommer Metallwerke GmbH, Emmering, Fed. Rep. of Germany

[21] Appl. No.: 769,604

[22] Filed: Oct. 1, 1991

[30] Foreign Application Priority Data

Apr. 17, 1991 [DE] Fed. Rep. of Germany ..... 4112593

[51] Int. Cl.[5] ..... F23G 5/12

[52] U.S. Cl. ..... 110/236; 110/229; 110/346; 134/19; 432/5; 432/72

[58] Field of Search ..... 432/5, 72; 110/236, 110/229, 341, 346; 134/19, 20, 21

[56] References Cited

U.S. PATENT DOCUMENTS

| | | | |
|---|---|---|---|
| 3,807,321 | 4/1974 | Stockman | 110/236 |
| 4,032,361 | 6/1977 | Eriksson et al. | 110/236 X |
| 4,141,373 | 2/1979 | Kartanson et al. | 110/236 X |
| 4,784,603 | 11/1988 | Robak, Jr. et al. | 432/5 |
| 4,789,332 | 12/1988 | Ramsey et al. | 432/59 |

*Primary Examiner*—Edward G. Favors
*Attorney, Agent, or Firm*—Jordan and Hamburg

[57] ABSTRACT

Waste products, particularly scrap metal, adulterated by organic components, is pyroprocessed by: (1) shredding the adulterated scrap metal into particles having a maximum size of 5 cm.; (2) in a pyrolysis stage operating at a temperature of approximately 550° C. to 600° C. converting the particles into solids and pyrolysis gas; (3) in a mechanical processing stage separating the solids into unadulterated metal and pyrolysis coke; and (4) in a high-temperature gasification stage into which an oxidizing agent and, optionally, metallurgical coke is introduced converting the pyrolysis coke together with pyrolysis gas stemming from the pyrolysis stage into a heating gas free of organic substances.

10 Claims, 1 Drawing Sheet

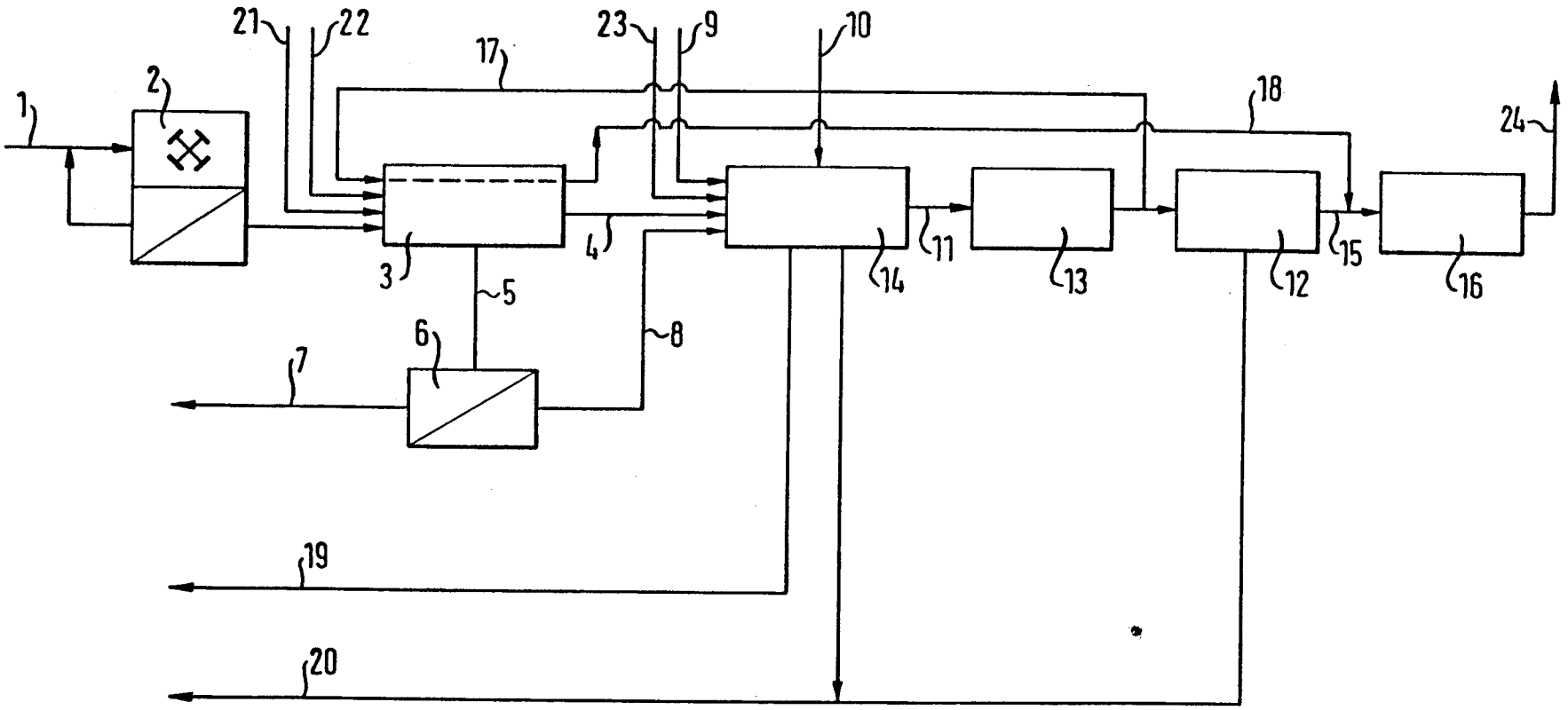
1
2
3
4
5
6
7
8
9
10
11
12
13
14
15
16
17
18
19
20
21
22
23
24

METHOD AND SYSTEM OF PYROPROCESSING WASTE PRODUCTS, PARTICULARLY SCRAP METAL, ADULTERATED BY ORGANIC COMPONENTS

FIELD OF THE INVENTION

The invention relates to a method of pyroprocessing waste products adulterated by organic components, more particularly aluminum scrap stemming from an automobile shredder adulterated by the organic plastics used in car making.

BACKGROUND OF THE INVENTION

From German patent DE 36 35 068 C2 a method of thermally disposing of waste such as soil, garbage, problematic wastes and sewage sludges contaminated with noxious substances is known in which all substances capable of being volatilized are transformed into the gaseous and/or vapor phase and separated from the solid products for disposal in this method the volatile substances stemming from the degassing procedure separated from the solid degassed products are passed over a solid bed of coke operating at a temperature of approx. 1200° C. in a reducing atmosphere excluding air and subsequently further purified before being applied to the high-temperature stage for incineration of the solid degasing products. This method makes no mention of it being suitable for processing particularly scrap metal.

As a single system a high-temperature gasifier stage is also known. This system requires, however, a high percentage of free primary energy.

Known as such are also pyrolysis stages. Here, however, cleaning the pyrolysis gas and the waste water is problematic and, apart from this, the coke used for pyrolysis is expensive in disposal.

SUMMARY OF THE INVENTION

The object of the invention is to provide a method or a system for pyroprocessing wastes adulterated by organic components in which the energy requirement is at a minimum for producing substances capable of being recycled and waste products for disposal at minimum expense.

According to the invention, waste products, particularly scrap metal, adulterated by organic components, are pyroprocessed by the following steps in series: (1) shredding the adulterated scrap metal into particles having a maximum size of 5 cm.; (2) in a pyrolysis stage operating at a temperature of approximately 550° C. to 600° C. converting the particles into solids and pyrolysis gas; (3) in a mechanical processing stage separating the solids into unadulterated metal and pyrolysis coke; and (4) in a high-temperature gasification stage into which an oxidizing agent and, optionally, metallurgical coke is introduced converting the pyrolysis coke together with pyrolysis gas stemming from the pyrolysis stage into a heating gas free of organic substances.

The outputs of the foregoing method are as follows:

metallic product of the pyrolysis stage cleaned by subsequent mechanical preparation which can, for instance, be furnished to a melting plant in the form of clean scrap metal;

vitrified construction material stemming from the high-temperature gasification stage and heating gas for consumer energy;

flue gas at the end of the system.

The pyrolysis gas resulting from the pyrolysis stage is scrubbed in the subsequent high-temperature gasification stage and converted into the products heating gas and vitrified slag suitable for marketing. The supply of primary energy to the high-temperature gasification stage is minimized by the supply of the pyrolysis gas stemming from the pyrolysis stage and can even be reduced to practically zero depending on the percentage of organic substances involved.

In addition, the input to the high-temperature gasification stage is simplified, since merely pyrolysis coke is required as regards solid components.

All in all a particularly favorable overall result is attained by the method of the invention by the arrangement and functional connection of single stages, some of which are known as such.

The high temperature gasification stage is operated preferably at a temperature of approximately 1600° C. The heating gas is cleaned of unwanted components such as HCl, HF and dust in a gas scrubber prior to its use as a source of energy. The cleaning in a gas scrubber may eliminate the need for a denitrification system as well as a dioxyn filter. Part of the gas cleaned in the gas scrubber is returned to the pyrolysis stage. Flue gas stemming from the use of the heating gas as a source of energy together with flue gas stemming from the pyrolysis stage may be desulfurized in a desulfurizing plant.

The invention also relates to a system for implementing the method of the invention. The system comprises the following processing stages in series: (1) a shredder system; (2) a pyrolysis stage operated at a temperature of approximately 550° C. to 600° C. and comprising supply lines for energy, for air or oxygen and for gas recycled within the system; (3) a high-temperature gasification stage operated at a temperature of approximately 1600° C. and comprising supply lines for energy, for an oxidizing agent and for pyrolysis coke. The high-temperature gasification stage may be followed by a gas scrubber and a boiler. The boiler may be followed by a flue gas desulfurizing plant.

BRIEF DESCRIPTION OF THE DRAWING

The drawing is a schematic flow diagram of a process and apparatus according to the invention.

DETAILED DESCRIPTION OF THE PREFERRED EMBODIMENT

The invention will now be explained on the basis of the sole drawing figure depicting the embodiment concerned schematically, this embodiment relating to the pyroprocessing of scrap metal.

The scrap metal 1 adulterated by the organic components is first through a shredder 2 which reduces it to a particle size of maximum 5 cm. Larger particles can be returned for repeat shredding in shredder 2.

The adulterated shredded scrap metal is then passed through a pyrolysis stage 3 which is operated at a temperature of approximately 550° C. thru 600° C. This pyrolysis stage 3 also receives a supply of energy 21 and air or oxygen 22. In the pyrolysis stage 3 the adulterated scrap metal is converted into solids 5 and pyrolysis gas by pyrolysis.

The solids 5 are then separated in a mechanical processing stage 6 into metal 7 suitable for reuse and pyrolysis coke 8.

The cleaned metal 7 can then be furnished to a melting plant as clean scrap metal.

The pyrolysis coke 8 is supplied to a high-temperature gasification stage 14 which also receives the pyrolosis gas 4 from the pyrolysis stage 3. In addition, the high-temperature gasification stage 14 also has supply lines for energy 23 and an oxidizing agent 9, e.g. air or oxygen, and, where necessary, for metallurgical coke 10 also.

Most of the energy required or in the ideal situation all of the energy required is provided by the pyrolysis gas, the extent to which this is provided depending on the percentage or organic substances. Merely the pyrolysis coke 8 needs to be sliced to the high-temperature gasification stage. The pyrolysis gas 4 is supplied via a burner.

The treatment in the high-temperature gasification stage 14 is carried out at a temperature of approximately 1600° C. resulting in a vitrified construction material 19 and energy 20 being liberated which can be made available to consumers.

The heating gas 11 resulting from the high-temperature gasification stage 14 is piped to a gas scrubber 13 where it is cleaned of unwanted components such as HCl, HF, dust and substances containing dust.

The cleaned gas is then made available as a source of energy for equipment 12, e.g. a boiler, requiring a source of energy. Part 17 of the cleaned gas is returned to the pyrolysis stage 3 to minimize the supply of primary energy.

The energy applied to the equipment 12 together with the energy 20 won from the high-temperature gasification stage is made available to consumers.

The application of energy to equipment 12 is followed by a flue gas desulfurization plant 16 but only when required. The flue gas desulfurization plant 16 can also receive the flue gas 18 resulting from the pyrolysis stage 3. After desulfurization the flue gas 24 is emitted to the atmosphere after passing through further cleaners, if necessary.

The above explains the invention with relation to the preparation of scrap metal; it can, however, be put to use just as well for the processing of other waste products such as garbage and problematic wastes.

What is claimed is:

1. A method of pyroprocessing waste products, particularly scrap metal, adulterated by organic components, comprising the following steps in series:

(a) shredding the adulterated scrap metal into particles having a maximum size of 5 cm.;

(b) in a pyrolysis stage operating at a temperature of approximately 550° C. to 600° C. converting the particles of adulterated scrap metal into solids and pyrolysis gas;

(c) in a mechanical processing stage separating the solids into unadulterated metal and pyrolysis coke; and (d) in a high-temperature gasification stage into which an oxidizing agent is introduced converting the pyrolysis coke together with pyrolysis gas stemming from the pyrolysis stage into a heating gas free of organic substances.

2. A method according to claim 1, wherein the high-temperature gasification stage is operated at a temperature of approximately 1600° C.

3. A method according to claim 1 wherein the heating gas is cleaned of unwanted components such as HCl, HF and dust in a gas scrubber and is thereafter used as a source of energy.

4. A method according to claim 3, wherein part of the gas cleaned in the gas scrubber is returned to the pyrolysis stage.

5. A method according to claim 1, wherein metallurgical coke is also introduced into the high-temperature gasification stage.

6. A method according to claim 4, wherein flue gas stems from the use of the heating gas as a source of energy and said flue gas is desulfurized in a desulfurizing plant.

7. A method according to claim 6, wherein flue gas stems from the pyrolysis stage and the flue gas from the pyrolysis stage is also desulfurized in the desulfurizing plant.

8. A system for implementing the method according to claim 5, comprising the following processing stages in series:

1) a shredder system;

2) a pyrolysis stage operated at a temperature of approximately 550° C. to 600° C. and comprising supply lines for energy form an external source, for air or oxygen and for a recycled gas;

3) a high-temperature gasification stage operated at a temperature of approximately 1600° C. and comprising supply lines for energy, for an oxidizing agent and for pyrolysis coke.

9. A system according to claim 8, wherein the high-temperature gasification stage is followed by a gas scrubber and a boiler.

10. A system according to claim 9, wherein the boiler is followed by a flue gas desulfurizing plant.

* * * * *